US010820379B2

(12) United States Patent
Ranish et al.

(10) Patent No.: US 10,820,379 B2
(45) Date of Patent: Oct. 27, 2020

(54) LAMP BASE ADAPTER DESIGN FOR BASELESS LAMPS

(71) Applicant: Applied Materials, Inc., Santa Clara, CA (US)

(72) Inventors: Joseph M. Ranish, San Jose, CA (US); Aaron Miller, Sunnyvale, CA (US); Oleg V. Serebryanov, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 16/390,862

(22) Filed: Apr. 22, 2019

(65) Prior Publication Data

US 2020/0053836 A1 Feb. 13, 2020

Related U.S. Application Data

(62) Division of application No. 15/281,715, filed on Sep. 30, 2016, now Pat. No. 10,271,383.

(60) Provisional application No. 62/240,696, filed on Oct. 13, 2015.

(51) Int. Cl.

| | |
|---|---|
| ***H05B 3/00*** | (2006.01) |
| ***H01R 12/70*** | (2011.01) |
| ***H01R 9/22*** | (2006.01) |

(52) U.S. Cl.

CPC ..... *H05B 3/0047* (2013.01)

(58) Field of Classification Search

None

See application file for complete search history.

(56) References Cited

U.S. PATENT DOCUMENTS

| | | | | |
|---|---|---|---|---|
| 4,396,860 | A * | 8/1983 | Hellwig | H01K 1/46 313/315 |
| 4,982,132 | A ‡ | 1/1991 | Meyer | F21V 19/0005 313/113 |
| 6,488,510 | B2 ‡ | 12/2002 | Li | H01R 35/04 362/64 |
| 2005/0218774 | A1 ‡ | 10/2005 | Bhagwat | H01J 5/48 313/318.01 |
| 2011/0298372 | A1 ‡ | 12/2011 | He | F21K 9/27 315/35 |
| 2015/0028736 | A1 * | 1/2015 | Derhaeg | H01J 5/60 313/39 |

(Continued)

OTHER PUBLICATIONS

Office Action dated Sep. 18, 2019 for Application No. 105133007.

*Primary Examiner* — Ashok Patel

(74) *Attorney, Agent, or Firm* — Patterson + Sheridan, LLP

(57) ABSTRACT

Implementations of the present disclosure provide an adapter for use in a processing chamber. In one implementation, the adapter comprises a hollow body having a first end and a second end opposing the first end, a first block and a second block symmetrically disposed within the hollow body about a longitudinal axis of the body, wherein the first block and the second block define a central opening therebetween, and a retention device disposed in contact with the first and second blocks to confine the movement of the first and second blocks with respect to the hollow body. The central opening is sized so that the first block and the second block provide direct contact with a press seal of the lamp.

20 Claims, 7 Drawing Sheets

(56) References Cited

U.S. PATENT DOCUMENTS

| | | | | |
|---|---|---|---|---|
| 2015/0179425 | A1‡ | 6/2015 | Ranish | H01K 1/46<br>219/408 |
| 2017/0164655 | A1* | 6/2017 | Chen | A24F 47/008 |

* cited by examiner
‡ imported from a related application

LAMP BASE ADAPTER DESIGN FOR BASELESS LAMPS

CROSS-REFERENCE TO RELATED APPLICATIONS

This application is a divisional application of U.S. patent application Ser. No. 15/281,715, filed Sep. 30, 2016, which claims priority to U.S. provisional patent application Ser. No. 62/240,696, filed Oct. 13, 2015, which is herein incorporated by reference.

FIELD

Implementations of the present disclosure generally relate to an apparatus for thermally processing a substrate. In particular, implementations of the present disclosure relate to an adapter for lamps used as a source of heat radiation in a processing chamber.

BACKGROUND

During rapid thermal processing (RTP) of substrates, thermal radiation is generally used to rapidly heat a substrate in a controlled environment to a maximum temperature of up to about 1350° C. This maximum temperature is maintained for a specific amount of time ranging from less than one second to several minutes depending on the particular process. The substrate is then cooled to room temperature for further processing.

High voltage, e.g., about 40 volts to about 130 volts, tungsten halogen lamps are commonly used as the source of heat radiation in RTP chambers. Current lamp assembly designs include a lamp body, a bulb, and a base coupled to the lamp body. The lamp base mates to a receptacle on a printed circuit board (PCB) structure, facilitating easy removal and replacement of the lamp assembly. When the bulb fails (typically the fuse or the filament within the bulb), the entire lamp assembly including the base coupled to the lamp body needs to be replaced even though the base itself is functioning properly. Replacement of a functional base due to a faulty bulb causes unnecessary waste and expense.

Therefore, it is desirable to provide an improved lamp design to reduce cost and provide ability to adjust height of the lamps as needed.

SUMMARY

Implementations of the present disclosure provide an adapter for use in a processing chamber. In one implementation, the adapter comprises a hollow body having a first end and a second end opposing the first end, a first block and a second block symmetrically disposed within the hollow body about a longitudinal axis of the body, wherein the first block and the second block define a central opening therebetween, and a retention device disposed in contact with the first and second blocks to confine the movement of the first and second blocks with respect to the hollow body. The central opening is sized so that the first block and the second block provide direct contact with a press seal of the lamp.

In another implementation, a lamp assembly is provided. The lamp assembly comprises a lamp comprising a lamp capsule having a filament disposed therein, and a press seal extending from the lamp capsule, and an adapter removably engaged with the lamp, wherein the adapter is a cylindrical hollow body having a first end and a second end opposing the first end, the adapter comprising a first cut-out and a second cut-out symmetrically disposed about a longitudinal axis of the adapter at the first end, a first block and a second block symmetrically disposed about the longitudinal axis of the adapter, wherein the first block is received within the first cut-out and the second block is received within the second cut-out, and a retention device disposed around the cylindrical hollow body to confine the movement of the first block and the second block within the cylindrical hollow body, wherein the first block and the second block define an opening to allow passage of the press seal.

In yet another implementation, the lamp assembly comprises a lamp comprising a lamp capsule having a filament disposed therein, and a press seal extending from the lamp capsule, and an adapter removably engaged with the lamp, wherein the adapter is a cylindrical hollow body having a first end and a second end opposing the first end, the adapter comprising a first block and a second block symmetrically disposed within the cylindrical hollow body about a longitudinal axis of the body, wherein the first block and the second block define an opening to allow passage of the press seal, and a retention device disposed around the cylindrical hollow body to confine the movement of the first block and the second block within the cylindrical hollow body.

BRIEF DESCRIPTION OF THE DRAWINGS

Implementations of the present disclosure, briefly summarized above and discussed in greater detail below, can be understood by reference to the illustrative implementations of the disclosure depicted in the appended drawings. It is to be noted, however, that the appended drawings illustrate only typical implementations of this disclosure and are therefore not to be considered limiting of its scope, for the disclosure may admit to other equally effective implementations.

Figure 1:
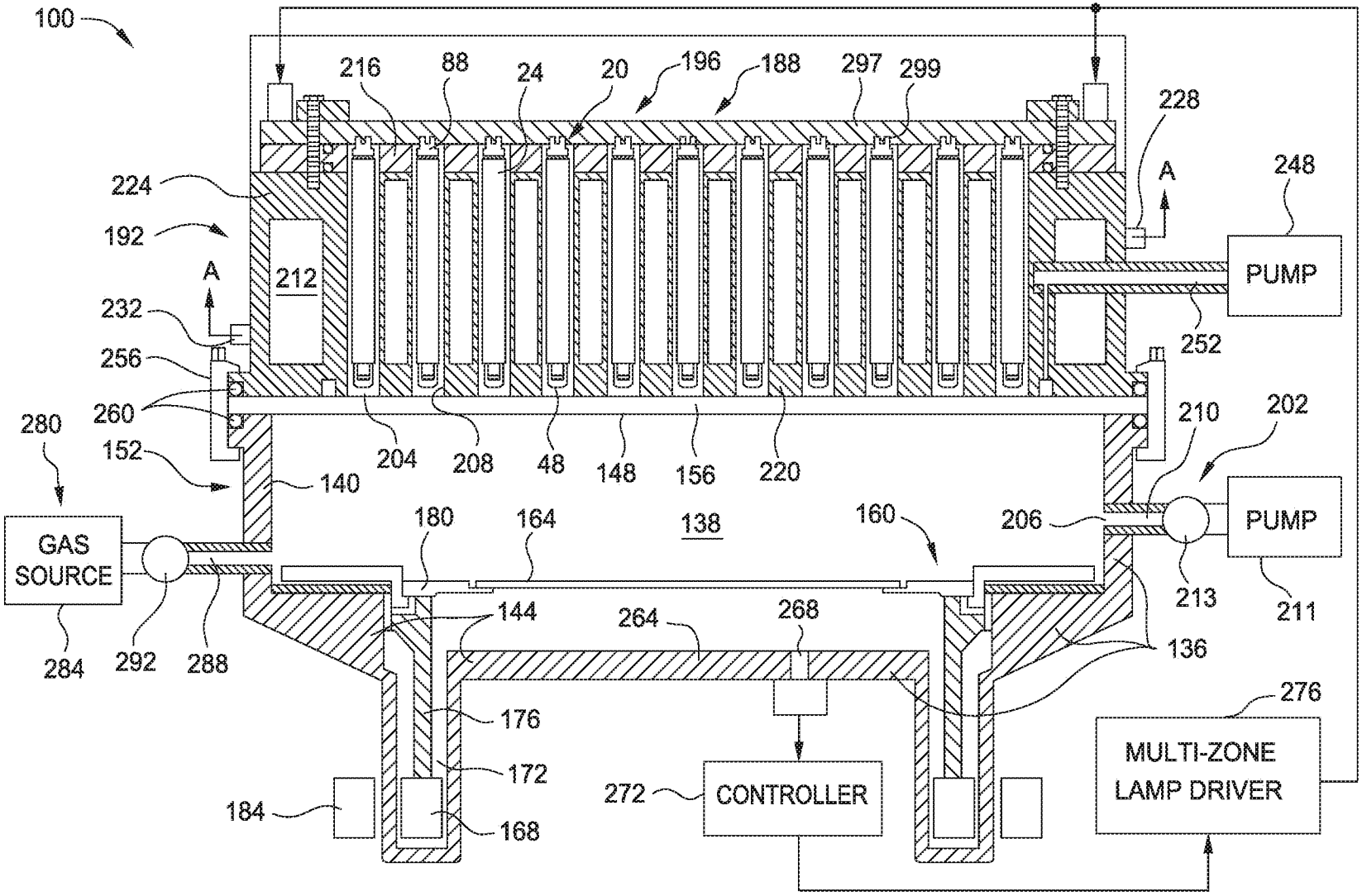
FIG. 1 is a schematic, cross-sectional view of an RTP chamber in which implementations of the present disclosure may be practiced.

To facilitate understanding, identical reference numerals have been used, where possible, to designate identical elements that are common to the figures. The figures are not drawn to scale and may be simplified for clarity. It is contemplated that elements and features of one implementation may be beneficially incorporated in other implementations without further recitation.

DETAILED DESCRIPTION

FIG. 1 is a schematic, cross-sectional view of a rapid thermal processing (RTP) chamber 100 in which implementations of the present disclosure may be practiced. The RTP chamber 100 is capable of providing a controlled thermal cycle that heats the substrate 164 for processes such as, for example, thermal annealing, thermal cleaning, thermal chemical vapor deposition, thermal oxidation and thermal nitridation. It is contemplated that implementations of the present disclosure may also be used in epitaxial deposition chambers which are heated from the bottom, the top, or both, and also other RTP chambers where bottom heating is used. The RTP chamber 100 includes chamber walls 136 enclosing a process zone 138. For example, the chamber walls 136 enclosing the process zone 138 can comprise sidewalls 140 and bottom walls 144 formed by a main body 152 and a top wall 148 formed by a window 156 resting on the main body 152. The main body 152 may be made of stainless steel, although aluminum and other suitable materials may also be used. The window 156 is made of a material that is transparent to infrared light, such as clear fused silica quartz.

A substrate support 160 holds the substrate 164 during processing in the process zone 138. The substrate support 160 may include a rotatable structure that rotates the substrate 164 during processing. For example, the support 160 may include a magnetically levitated rotor 168 positioned within a channel 172 in the main body 152. The magnetically levitated rotor 168 supports a quartz support cylinder 176, on top of which is a support ring 180 to hold the substrate 164. A magnetic stator 184 located externally to the channel 172 containing the rotor 168 is used to magnetically induce rotation of the rotor 168 in the channel 172, which in turn causes rotation of the substrate 164 on the support ring 180. The substrate 164 may be rotated, for example, at about 100 to about 250 revolutions per minute.

A radiation source 188 directs radiation onto the substrate 164, and can be positioned above the substrate 164, such as in a ceiling 192 of the RTP chamber 100 above the radiation permeable window 156 at the top of the process zone 138. The radiation source 188 generates radiation at wavelengths that heat the substrate 164, such as radiation having wavelengths of from about 200 nm to about 4500 nm. In one implementation, the radiation source 188 may include a honeycomb array 196 of lamp assemblies 20. The array 196 may include one or more approximately radial heating zones that can be independently modulated to control temperatures across the substrate 164. For example, in one aspect, the radiation source 188 may include 409 lamps divided into 15 radially symmetric zones. Each zone can be independently controlled to provide fine control of the radial profile of heat delivered to the substrate 164. The radiation source 188 is capable of rapidly heating the substrate 164 for thermal processing, for example at a rate of from about 50° C./s to about 280° C./s.

Each lamp assembly 20 in the array 196 of lamp assemblies 20 is enclosed in a tubular lamp assembly housing 204. One end of the lamp assembly housing 204 is adjacent to the transmission window 156. The lamp assembly housing 204 may have a reflective inner surface 208 to increase the efficiency of light and heat transfer from the lamp assemblies 20 to the substrate 164. The lamp assembly housing 204 may be enclosed in a fluid cooling chamber 212 defined by upper and lower fluid chamber walls 216, 220 and a cylindrical fluid chamber side wall 224. Clamps 256 secure the main body 152, window 156, and cooling chamber 212 together. O-rings 260 are located between the window 156 and the cooling chamber 212 and between the window 156 and the main body 152 to provide a vacuum seal at those interfaces. A cooling fluid, such as, for example, water, can be introduced into the cooling chamber 212 through a cooling fluid inlet 228 and removed from the cooling chamber 212 through a cooling fluid outlet 232.

Figure 2:
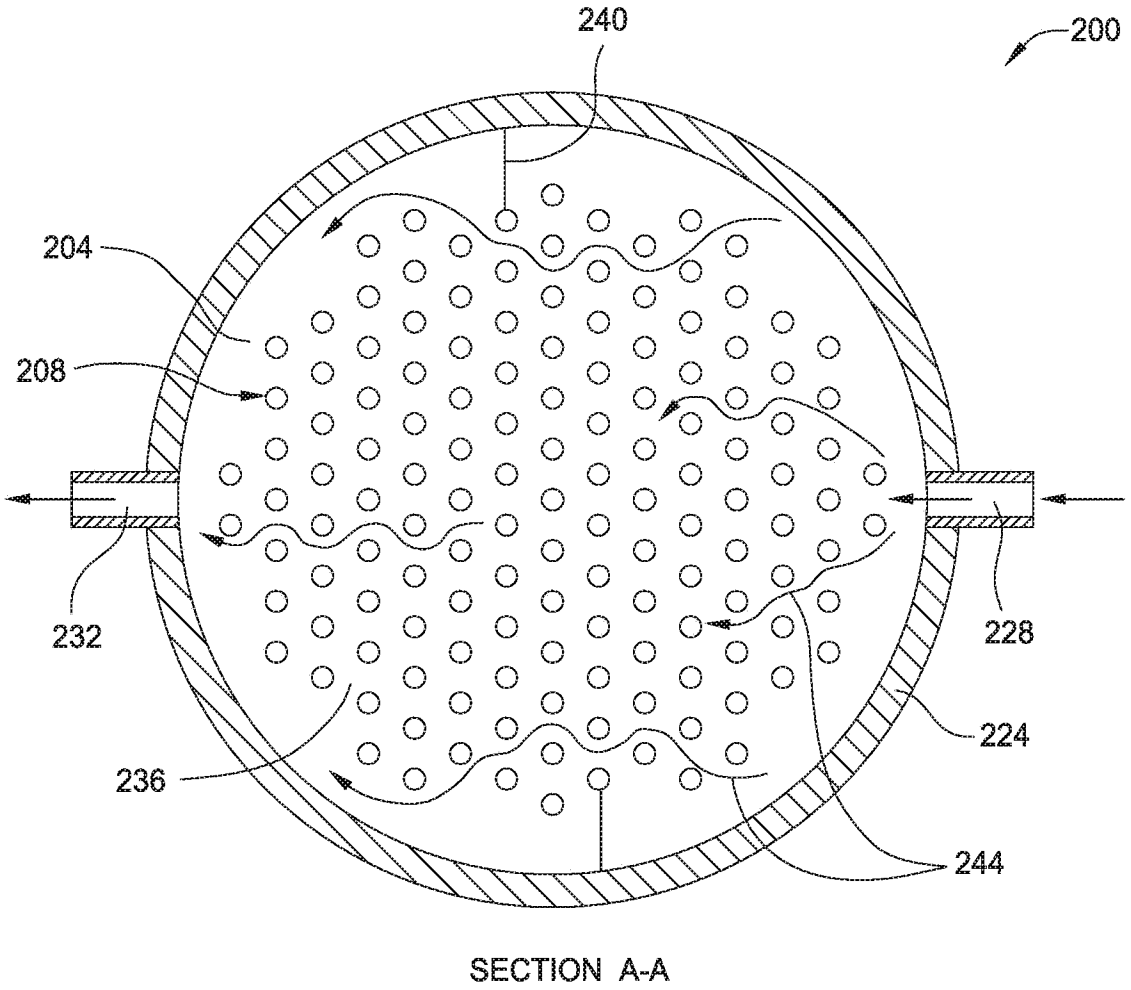
FIG. 2 illustrates a top view of the array of lamp assemblies in lamp assembly housings in the cooling chamber.

FIG. 2 illustrates a top view of the array 196 of lamp assemblies 20 in lamp assembly housings 204 in the cooling chamber 212. Cooling fluid travels in the space 236 between the lamp assembly housings 204, and may be directed by baffles 240 to ensure an effective fluid flow to transfer heat from the lamp assemblies 20 in the lamp assembly housings 204. A vacuum pump 248 is provided to reduce the pressure in the lamp assembly housings 204. The vacuum pump 248 is coupled to the lamp assembly housings 204 by a conduit 252 in the cylindrical sidewall 224 and grooves in the bottom wall 220 of the cooling chamber 212.

In some implementations, a pressurized source (not shown) of a thermally conductive gas, such as helium, may be provided and configured to cool the lamp assembly housing 204 with the thermally conductive gas, thereby facilitating thermal transfer between the lamps assemblies 20 and the cooling chamber 212. The pressurized source may be connected to the lamp assembly housing 204 through a port and a valve. The thermally conductive gas may be introduced in a manner so that the lamp assembly housing 204 (and therefore the lamp assembly 20 disposed therein) is operated under reduced pressure of the thermal conductive gas.

The bottom wall 144 of the main body 152 may include a reflective plate 264 positioned below the substrate 164. One or more temperature sensors 268, such as pyrometers having fiber optic probes, may also be provided to detect the temperature of the substrate 164 during processing. The sensors 268 are connected to a chamber controller 272, which can use their output to determine a power level to supply to individual lamp assemblies 20 and to groups of lamp assemblies 20 in a zone. Each group of lamp assemblies 20 can be separately powered and controlled by a multi-zone lamp driver 276, which is in turn controlled by the controller 272.

A gas supply 280 can provide a process gas into the process zone 138 and control the atmosphere in the RTP chamber 100. The gas supply 280 includes a source 284 of process gas and a conduit 288 having a flow control valve 292 that connects the source 284 to a gas inlet (not shown) in the RTP chamber 100 to provide gas in the RTP chamber 100. An exhaust 202 controls the pressure of gas in the RTP chamber 100 and exhausts process gas from the RTP chamber 100. The exhaust 202 may include one or more exhaust ports 206 that receive spent process gas and pass the spent gas to an exhaust conduit 210 that feeds one or more exhaust pumps 211. A throttle valve 213 in the exhaust conduit 210 controls the pressure of the gas in the RTP chamber 100.

The RTP chamber 100 may further include a printed circuit board (PCB) structure 297 on top of the upper cooling fluid chamber wall 216. The PCB structure 297 may include receptacles 299 configured to receive electrical connectors of the lamp assembly 20. The PCB structure 297 may also include electrical traces and other electrical elements to deliver power and signals to the lamp assemblies 20 from the multi-zone lamp driver 276 and controller 272. Each of the plurality of lamp assemblies 20 is inserted into the PCB structure 297 for electrical connection through the driver 276 to a power supply source (not shown).

Exemplary Lamp Assembly

Figure 3A:
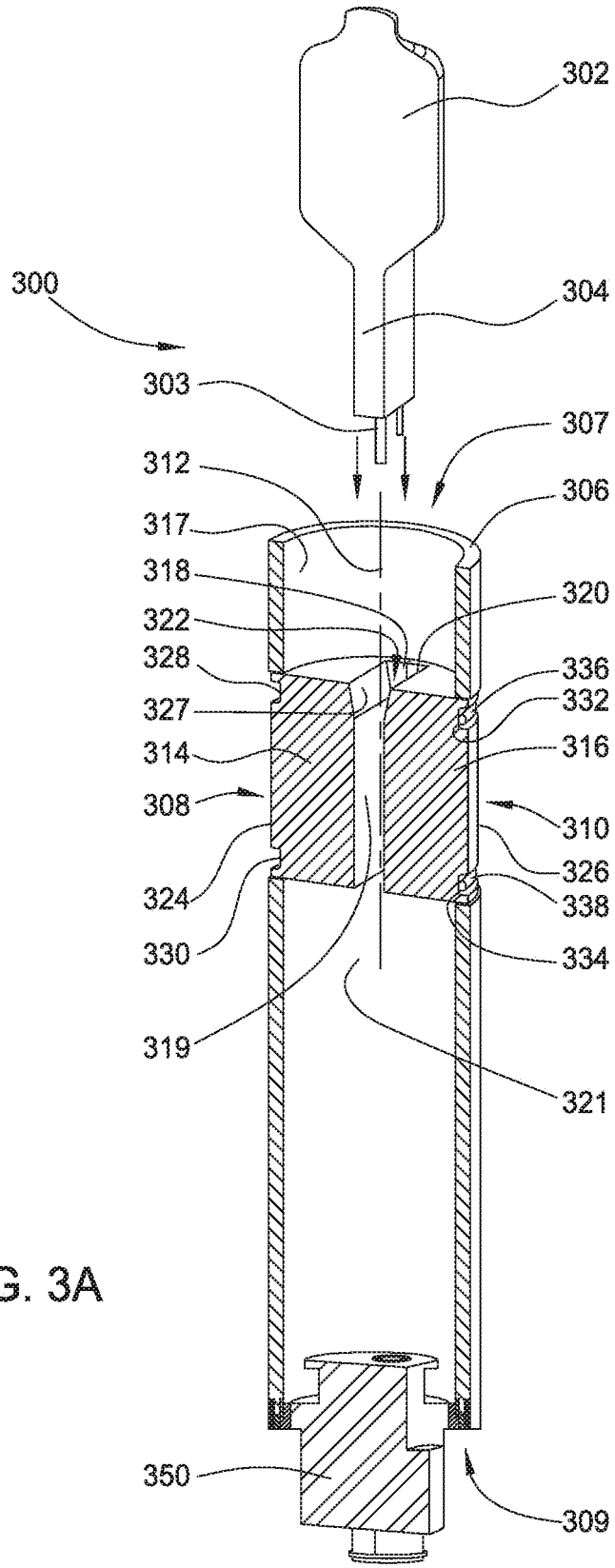
FIG. 3A illustrates a cross-sectional perspective view of a lamp assembly for use in an RTP chamber according to implementations of the disclosure.

FIG. 3A illustrates a cross-sectional perspective view of a lamp assembly 300 for use in an RTP chamber, such as the RTP chamber 100, according to implementations of the disclosure. The lamp assembly 300 may be used in place of the lamp assembly 20 shown in FIG. 1. It is contemplated that implementations of the present disclosure may also be used in other RTP chambers where bottom heating is used, other thermal processing chambers, such as epitaxial deposition chambers which are heated from the bottom, the top, or both, or any processing chambers where a lamp assembly is used to process the substrate. It should be noted that the concept and features described in FIG. 3 are equally applicable to other implementations discussed in this disclosure.

The lamp assembly 300 generally comprises a lamp capsule 302 having a press seal 304 extending from one end of the lamp capsule 302 (the lamp capsule 302 and the press seal 304 may collectively refer to as a lamp), and an adapter 306 for removably engaged with at least a portion of the press seal 304. The press seal 304 has electrically conductive wires or leads 303 extending out of the press seal 304. The lamp capsule generally contains a filament (not shown) that is electrically connects to the electrically conductive wires or leads disposed within the press seal 304.

The lamp may or may not have a fuse in the lamp capsule 302 or the press seal 304. The fuse is generally provided to limit arcing and potential explosion in the lamp during lamp failure. The fuse (not shown) may be provided external to the lamp capsule 302 and the press seal 304 to prevent undesirable cracking or breaking of the capsule during lamp failure. In cases where the lamp is a simple capsule/fuse style (i.e., the adapter does not contain a fuse and the fuse is incorporated internal or external to the lamp), the fuse can be replaced along with the lamp. In cases where the lamp is a simple capsule style (i.e., the fuse is not used in the lamp and may be provided by the adapter), the adapter 306 may optionally provide a fuse to be connected to the electrically conductive wires or leads 303 of the lamp. In this case, the fuse can be made separated from the adapter 306 and be replaced through the top of the adapter 306.

The adapter 306 may be an elongate body having a first end 307 and a second end 309 opposing the first end 307. In one implementation, the adapter 306 is a substantially cylindrical hollow body. The second end 309 of the adapter 306 may be sealed or closed with a plug 350. The plug 350 may be a flexible plug or a rigid plug that can be adjusted so that tolerances between the lamp and the PCB will be accommodated by either a controlled floating rigid plug with clearance holes or more fixed rigid plug with larger conductor holes for conductors to engage with the PCB. In some implementations, the plug 350 may include tubular-like extensions extending upwardly from the top surface of the plug 350 to provide additional insulation and guidance to the lamp leads (e.g., electrically conductive wires or leads 303). High temperature polyimides are one possibility for materials along with more conventional plastics. The plug 350 may also include features to hold the axial position of the two blocks 314, 316 (to be discussed below) to prevent relative sliding between the plug 350 and the blocks 314, 316.

The electrically conductive wires or leads 303 from the press seal 304 may extend through and out of the plug 350 in a direction along a longitudinal axis 312 of the adapter 306 to insert into respective electrically conductive receptacles (e.g., receptacles 299 shown in FIG. 1) formed within the PCB structure 297 for distributing power to the filament (not shown) in the lamp capsule 302.

The wall thickness of the cylindrical hollow body, i.e., the wall surrounding the lamp capsule 302, may be about 0.5 mm to about 30 mm. It should be noted that the wall thickness may vary for rectangular cross section press seals in circular cross section adapter, depending upon the application.

Figure 3B:
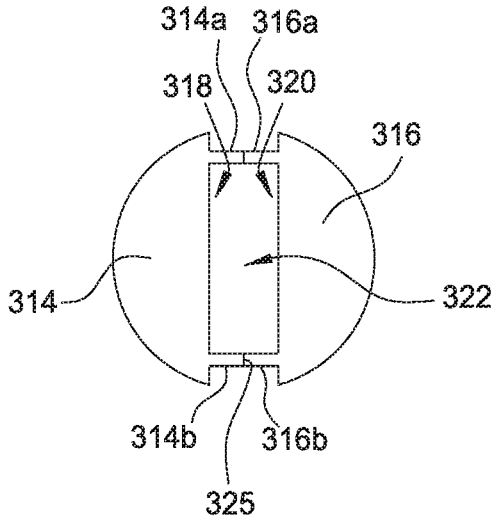
FIG. 3B illustrates a schematic top view of the blocks being combined to define an opening according to one implementation of the present disclosure.
Figure 3C:
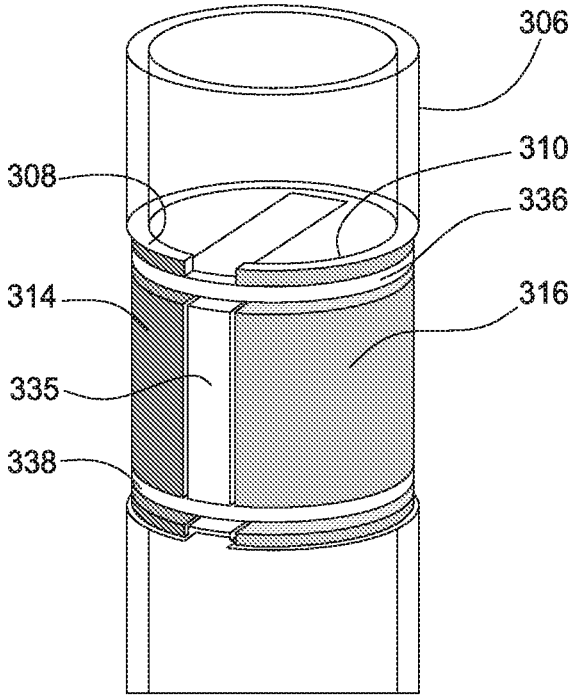
FIG. 3C illustrates a perspective view of a portion of the lamp assembly showing how the blocks are secured by the O-rings.

The adapter 306 has two cut-outs 308, 310 symmetrically disposed about a longitudinal axis 312 of the adapter at the first end. The cut-outs 308, 310 are formed in the wall of the cylindrical hollow body of the adapter 306, leaving a joint portion 335 on either side of the adapter 306 (only one joint portion 335 is shown in FIG. 3C). Therefore, the cut-outs 308, 310 are separated by the joint portion 335. In one implementation as shown in FIG. 3C, the two cut-outs 308, 310 extend circumferentially and symmetrically to meet at the joint portion 335 disposed on opposing sides of the adapter 306. The contact surfaces of the cut-outs 308, 310 may be coated or have a conformal thermal contact material applied. In one example, the coating or the thermal contact material may include glassy carbon, graphite, boron nitride, or mica.

The cut-outs 308, 310 are sized and adapted to receive a pair of blocks 314, 316. The blocks 314, 316 may be symmetrically disposed about the longitudinal axis 312 of the adapter 306. In one implementation as shown, the blocks 314, 316 are physically separated from the adapter 306. The blocks 314, 316 may have an exterior shape accommodating to the cylindrical shape of the adapter 306. In one implementation, the blocks 314, 316 are two approximately half-cylindrical sections, which when combined, are received or nested within the respective cut-out 308, 310. That is, the block 314 is received within the cut-out 308 while the block 316 is received within the cut-out 310 when assembled. Each block 314, 316 has a recess 318, 320 formed in the respective half-cylindrical section along the diameter of the block to provide sidewalls 314*a*, 314*b*, 316*a*, 316*b* for the blocks 314, 316. When two blocks 314, 316 are combined, the recesses 318, 320 and sidewalls 314*a*, 314*b*, 316*a*, 316*b* define a central opening 322 corresponding to the shape of the press seal 304. The blocks 314, 316 may have a height corresponding to, less than, or greater than the length of the press seal 304. In some implementations, the overall axial length of the blocks 314, 316 could be longer than the press seal 304. FIG. 3B illustrates a schematic top view of the blocks 314, 316 being combined to define the opening 322 according to one implementation of the present disclosure.

The central opening 322 is adapted to allow passage of the press seal 304. Particularly, the opening 322 is sized such that the blocks 314, 316 are in an interference fit to the press seal 304 when the lamp is inserted into the adapter 306. In other words, when the adapter 306 does not have a lamp installed, the spacing (i.e., the central opening 322) between blocks 314, 316 is smaller than the smallest possible width (e.g., "W1" shown in FIG. 3A) of the press seal 304. Having the spacing smaller than the width of the press seal ensures intimate contact between the press seal 304 and the blocks 314, 316. The interference opening of the press seal area of the adapter 306 means that there will be a larger air gap between the outside of the adapter 306 and the lamp housing (e.g., tubular lamp assembly housing 204 shown in FIG. 1) when installed. In various implementations, the press seal 304 may have a constant width of about 1 mm to about 5 mm, for example about 2 mm.

The upper portion of the blocks 314, 316 may have an angled surface 327 configured to comply with the profile of the lamp capsule 302 and/or press seal 304 when the press seal 304 is fully inserted into the opening 322. When blocks 314, 316 are combined, the sidewalls 314*a*, 314*b* of the block 314 and the sidewalls 316*a*, 316*b* of the block 316 are abutted against each other. The blocks 314, 316 (as well as the joint portion 335) may each have one or more grooves formed in the outer peripheral surface to receive an O-ring or a C-shaped ring. In one implementation shown in FIG. 3A, the block 314 has two grooves 328, 330 formed in the outer surface 324 and the block 316 has two grooves 332, 334 formed in the outer surface 326. The grooves 328, 332 and the grooves 330, 334 are configured to receive an O-ring 336, 338, respectively.

FIG. 3C illustrates a perspective view of a portion of the lamp assembly 300 showing how the blocks 314, 316 are secured by the O-rings. The bulb (e.g., lamp capsule 302 and press seal 304) has been omitted for clarity. The O-rings 336, 338 securely confine the movement of the blocks 314, 316 within the cylindrical hollow body so that the opening 322 makes intimate contact with the press seal 304. The O-ring tension may be adjusted to provide the proper contact pressure on the press seal. This intimate contact serves as a cooling path to facilitate heat transfer from the press seal 104 to the outside world. As a result, the lamp assembly 100 can be operated at a temperature low enough to permit longer lamp life.

It is contemplated that while the central opening 322 is shown as a rectangular opening, this geometry of the central opening 322 should not be limited and can be altered to fit the shape/design of the press seal. In addition, the split may be machined to more closely represent the lamp capsule 302. This can include retention features in the contact area such as matching indents and protrusions and the like. Alternatively, the grooves or the press seal may be machined into the split so as to easily decrease the thermal contact from the lamp to the adapter 306.

In one implementation, which can be combined with other implementations described in this disclosure, the adapter 306 may be made with a high thermal conductivity material such as a metal (e.g., copper, aluminum or stainless steel) or ceramic (e.g., aluminum nitride, silicon carbide, alumina, silicon nitride) to facilitate heat transfer between the lamp capsule/press seal and the outside world. In one implementation, aluminum is utilized for the cylindrical hollow body to increase the thermal conductivity of the adapter 306. The blocks 314, 316 may be made of copper, aluminum, stainless steel or any other suitable materials.

In addition to the O-rings discussed above, it is contemplated that the blocks 314, 316 may be held against to each other by any suitable manner, for example a retention features such as a clip, a contact spring, a spring-loaded member, a notch, etc., that may be used to confine the movement of the blocks 314, 316. These retention features may be disposed at the joint surfaces (collectively shown as 325 in FIG. 3B for illustrative purposes) of the symmetric blocks 314, 316, for example 314*a* and 316*a* or 314*b* and 316*b*, or any other suitable locations of the blocks 314, 316. Additionally or alternatively, the joint surfaces of the blocks 314, 316 may be provided with one or more alignment guides to facilitate assembly of the blocks 314, 316. For example, one or more guide pins may be provided to any desired locations of the joint surface of the block 314 while one or more corresponding bores may be provided to the joint surface of the block 316. Upon insertion of the guide pins into the corresponding bores to place two blocks 314, 316 in alignment, the blocks 314, 316 are then securely connected and abutted against each other by use of the O-ring 336 disposed within the one or more grooves 328. In some implementations, which can be incorporated into other implementations of the present disclosure, one or more retention features may be formed in the blocks 314, 316 to engage with corresponding retention features of the press seal 304. For example, an extension may be formed on the surface of the press seal 304, such that when engaged, the extension snaps into a groove that is formed in the surface of the blocks 314, 316, for example interior surface 319 of the blocks 314, 316, and locks them into place. Other retention features such a clip, a contact spring, a spring-loaded member, a notch, etc., may also be used.

In addition, while the blocks 314, 316 are shown to have four sidewalls, any two abutting sidewalls, for example 314*a* and 316*a* or 314*b* and 316*b*, may be integrated as one single sidewall to simplify the manufacturing process.

In some implementations, which can be combined with other implementations described in this disclosure, the upper inner surface of the adapter 306 and/or interior surface 309 of the blocks 314, 316 may be coated to aid in directing radiation to the target in a controlled manner or modify the radiant heating of the adapter. For example, the upper inner surface 317 of the adapter 306 and/or interior surface 319 of the blocks 314, 316 may be coated with a light reflecting material such as aluminum, protected aluminum, gold or gold-plated aluminum, or even a diffuse reflective material such as titania, alumina, silica, zirconia, or hafnia. The upper inner surface 317 of the adapter 306 described herein refers to the surface facing the bulb (i.e., above the press seal area 333 and surrounds a portion of the lamp capsule 302) while the interior surface 319 refers to the surface that is in physical contact with the press seal 304. Having a light reflecting material applied to the upper inner surface 317 (above the press seal area 333) of the adapter 306 can increase the amount of forward radiation power gained from the lamp.

In some implementations, which can be combined with other implementations described in this disclosure, the upper inner surface 317 and/or interior surface 319 of the blocks 314, 316 may include conformal films, or conformal layers of material to further decrease the thermal contact resistance between the press seal surfaces and the inner walls of the central opening 322.

Figure 3D:
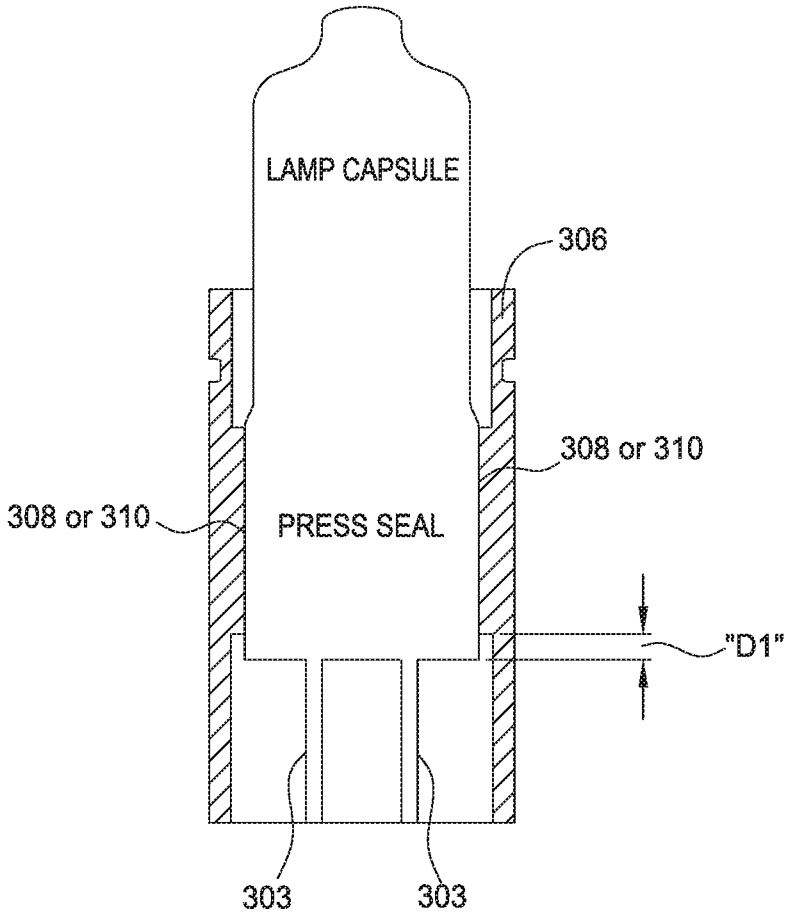
FIG. 3D illustrates a cross-sectional perspective view of a lamp assembly showing the spacing "D1" between the press seal area and the electrically conductive wires or leads from the press seal.

In some implementations, which can be combined with other implementations described in this disclosure, the lower inner surface 321 of the adapter 306 below the press seal area 333 may provide an insulative layer to reduce the likelihood of arcing or potential explosion in the lamp during lamp failure. The insulative layer may be in the form of a coating, an inner sleeve, molding, etc. Additionally or alternatively, arcing can be controlled by increasing the spacing "D1" between the press seal area 333 of the adapter and the electrically conductive wires or leads 303 from the press seal 304, as shown in FIG. 3D. The spacing "D1" may be manipulated by the dimension of the cut-outs 308, 310, the length of the blocks, the length of the press seal 304, or any of these in combination.

Figure 4A:
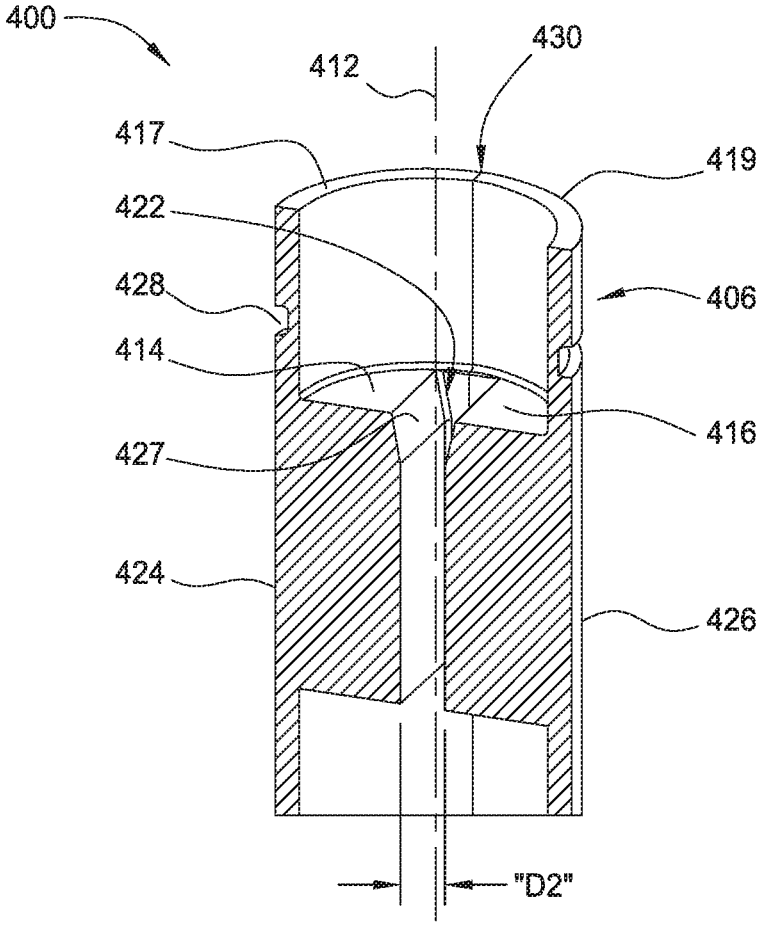
FIG. 4*a* illustrates a cross-sectional perspective view of a lamp assembly according to another implementation of the disclosure.

FIG. 4A illustrates a cross-sectional perspective view of a lamp assembly 400 according to another implementation of the disclosure. The lamp assembly 400 may be used in place of the lamp assembly 20 shown in FIG. 1. The lamp assembly 400 is an elongate body, which is similar to the lamp assembly 300 except that the adapter 406 is split into two symmetric sections 417, 419 along a longitudinal axis 412 of the adapter 406. Each section 417, 419 has a block 414, 416 extending inwardly from the interior surface of the adapter 406 to define an opening 422 for the press seal 304 (see FIG. 4B) of the lamp. Particularly, blocks are not physically separated from the adapter as illustrated in the implementation of FIG. 3A. Instead, the blocks 414, 416 in this implementation are part of the adapter 306, i.e., the block 414 and the section 417 are integrated as one single unit, and the block 416 and the section 419 are integrated as one single unit. The blocks 414, 416, once combined, have a top-view similar to the configuration shown in FIG. 3B but without the cut-outs for the joint portions 335.

Figure 4B:
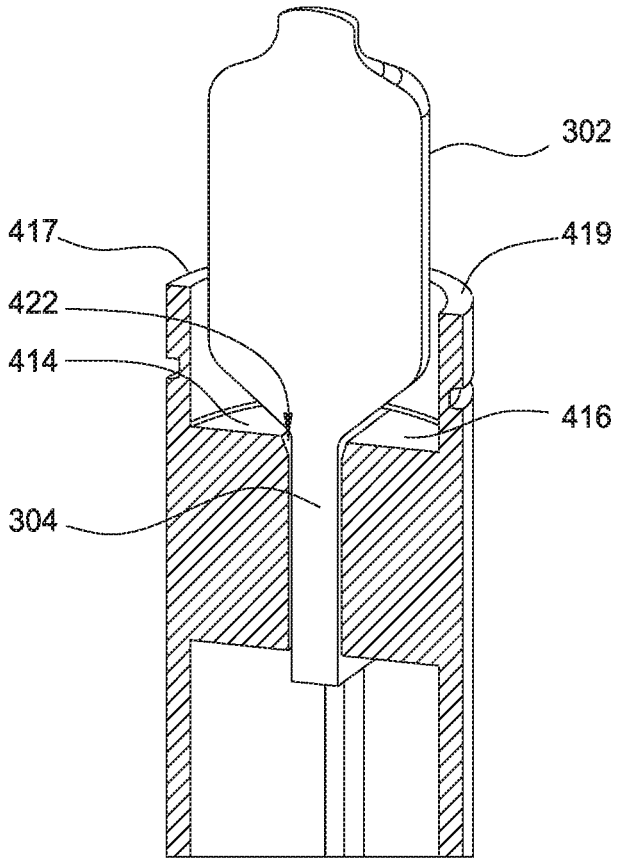
FIG. 4B illustrates a cross-sectional perspective view of a portion of the lamp assembly having a lamp fully inserted into the opening.

Similarly, the upper portion of the blocks 414, 416 may have an angled surface 427 configured to comply with the profile of the lamp capsule 302 and/or press seal 304 (see FIG. 4B) when the press seal 304 is fully inserted into the opening 422. Each section 417, 419 has a cylindrical outer surface 424, 426 and one or more grooves 428 formed in the cylindrical outer surface 424, 426, respectively. In some implementations, the joint surfaces (collectively shown as 430 for illustrative purposes) of the symmetric sections 417, 419 may be provided with one or more alignment guides to facilitate assembly of the sections 417, 419. For example, one or more guide pins may be provided to any desired locations of the joint surface of the section 417 while one or more corresponding bores may be provided to the joint surface of the section 419. Upon insertion of the guide pins into the corresponding bores to place the two sections 417, 419 in alignment, the two sections 417, 419 are then securely connected and abutted against each other by use of a retention ring (not shown, such as an O-ring 336 shown in FIG. 3A) disposed within the one or more grooves 428. FIG. 4B illustrates a cross-sectional perspective view of a portion of the lamp assembly 400 having a lamp fully inserted into the opening.

The opening 422 defined by the blocks 414, 416 allows passage of the press seal 304 (see FIG. 4B). Similarly, the opening 422 is sized such that the blocks 414, 416 are in an interference fit to the press seal 304 before the lamp is inserted into the adapter 406, as discussed above with respect to FIGS. 3A-3D. When the adapter 400 does not have a lamp installed, the spacing "D2" is smaller than the smallest possible width (e.g., "W1" shown in FIG. 3A) of the press seal to ensure intimate contact from the press seal to the adapter 400. In other words, under all tolerance conditions of the lamp, the adapter 406 will split apart when the press seal of the lamp is inserted. This split may be advantageous since it will be able to accommodate relatively large sizes of fuses (if used in the lamp). Without the ability for the adapter 406 to split, the fuse size is forced to be smaller in cross section than the width of the press seal on the lamp capsule. Since the adapter 406 can be spaced farther apart when the lamp is inserted, it can accommodate a larger fuse, thereby minimizing arcing and potential explosion in the lamp during lamp failure. This intimate contact between the press seal and the blocks 414, 416 also serves as a cooling path to facilitate heat transfer from the press seal to the outside world. As a result, the lamp assembly can be operated at a temperature low enough to permit longer lamp life.

Implementations of the present disclosure provide an improved lamp adapter that is split into two symmetric sections along a longitudinal axis of the adapter, and the two symmetric sections are spring loaded such that the spacing between the two sections at the press seal area is sized such that the sections make intimate contact with both sides of the press seal of the lamp. Benefits of the present disclosure include a direct, intimate contact between the lamp adapter and the press seal area to keep the thermals of the lamp within range for sustained operation. The intimate contact serves as a cooling path to facilitate heat transfer from the press seal to the outside world. As a result, the lamp assembly 100 can be operated at a temperature low enough to permit longer lamp life. In addition, the split of the adapter is capable of accommodating relatively large sizes of fuses, thereby minimizing arcing and potential explosion in the lamp during lamp failure.

While the foregoing is directed to implementations of the present disclosure, other and further implementations of the disclosure may be devised without departing from the basic scope thereof. For example, the two symmetric sections 417, 419 shown in FIGS. 4A and 4B need not be symmetric. The opening 422 may be disposed symmetric to the longitudinal axis 412 but the sections or parts defining it do not necessarily have to be symmetric. In some implementations, the concepts of FIGS. 3A-3C and 4 may be combined so that the two symmetric sections or blocks are captured like one shown in FIGS. 3A-3C but the contact pad against the press seal 304 do not extend the entire length of the adapter.

The invention claimed is:

1. An adapter for use in a processing chamber, comprising:

a hollow body having a first end and a second end opposing the first end, the hollow body further having a first cut-out and a second cut-out symmetrically disposed about a longitudinal axis of the hollow body;

a first block and a second block symmetrically disposed within the hollow body about the longitudinal axis of the body, wherein the first block and the second block define an opening therebetween for receiving a portion of a lamp, the lamp comprising a lamp capsule and a press seal extending from the lamp capsule, the opening being sized to allow passage of the press seal, wherein the first block is received within the first cut-out and the second block is received within the second cut-out so that the first and second blocks make direct contact with the press seal; and a retention device disposed in contact with the first and second blocks to confine the movement of the first and second blocks with respect to the hollow body.

2. The adapter of claim 1, where an upper portion of each of the first block and the second block comprises an angled surface to comply with a profile of the lamp capsule.

3. The adapter of claim 1, wherein the first block and second block are two sections physically integrated with the hollow body.

4. The adapter of claim 1, wherein the first block and second block are two sections separated from the hollow body.

5. The adapter of claim 1, wherein the hollow body is substantially cylindrical.

6. The adapter of claim 1, wherein the lamp is received at the first end of the hollow body, and a plug is received at the second end of the hollow body to seal the second end.

7. The adapter of claim 1, wherein the first cut-out and the second cut-out are separated by a first joint portion and a second joint portion disposed on opposing sides of the hollow body.

8. The adapter of claim 1, wherein the opening is defined by a recess formed in a sidewall of each of the first block and the second block.

9. The adapter of claim 8, wherein the opening has a rectangular shape.

10. An adapter for use in a processing chamber, comprising:

a hollow body having a first end and a second end opposing the first end, the hollow body further having a first cut-out and a second cut-out symmetrically disposed about a longitudinal axis of the hollow body;

a first block and a second block symmetrically disposed within the hollow body about the longitudinal axis of the hollow body, the first block is received within the first cut-out and the second block is received within the second cut-out, wherein the first block and the second block define an opening therebetween; and a retention device disposed in contact with the first and second blocks to confine the movement of the first and second blocks with respect to the hollow body.

11. The adapter of claim 10, wherein the first block and second block are two sections physically integrated with the hollow body.

12. The adapter of claim 10, wherein the first block and second block are two sections separated from the hollow body.

13. The adapter of claim 10, wherein the hollow body is substantially cylindrical.

14. The adapter of claim 10, further comprising a flexible plug disposed in at least one of the first end and the second end of the hollow body.

15. The adapter of claim 10, wherein the first cut-out and the second cut-out are separated by a first joint portion and a second joint portion disposed on opposing sides of the hollow body.

16. The adapter of claim 10, wherein the first cut-out and the second-cut out each comprise one or more contact surfaces comprising a coating or a thermal contact material.

17. The adapter of claim 10, wherein the opening is defined by a recess formed in a sidewall of each of the first block and the second block.

18. The adapter of claim 17, wherein the opening has a rectangular shape.

19. The adapter of claim 10, where an upper portion of each of the first block and the second block comprises an angled surface relative to a normal of the longitudinal axis of the body.

20. The adapter of claim 10, wherein the body comprises a high thermal conductivity material comprising at least one of copper, aluminum, stainless steel, aluminum nitride, silicon carbide, alumina, silicon nitride.

* * * * *